US006259881B1

(12) United States Patent
Nakamura

(10) Patent No.: US 6,259,881 B1
(45) Date of Patent: Jul. 10, 2001

(54) PAPER GUIDING SYSTEM

(75) Inventor: Toshiyuki Nakamura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/522,002

(22) Filed: Mar. 9, 2000

(30) Foreign Application Priority Data

Mar. 17, 1999 (JP) ..... 11-072141

(51) Int. Cl.[7] ..... G06G 15/20

(52) U.S. Cl. ..... 399/323

(58) Field of Search ..... 399/323

(56) References Cited

U.S. PATENT DOCUMENTS 4,806,966 * 2/1989 Suga ..... 399/323

5,448,347 * 9/1995 Mills ..... 399/323

* cited by examiner

*Primary Examiner*—Quana M. Grainger
(74) *Attorney, Agent, or Firm*—Smith, Gambrell & Russell, LLP

(57) ABSTRACT

The present invention is directed to a paper guiding device in an image forming apparatus, which is provided with claw displacement means for displacing a stripping claw 5, such that a front end 7 of the stripping claw 5 separates from a position in contact with the surface of a pressure roller 2, in synchronism with an operation of releasing a paper guide 4 from the pressure roller 2. The claw displacement means has a bar 12 and an operating plate 13. The operating plate 13 is slid in a direction indicated by an arrow X1 in synchronism with the operation of releasing the paper guide 4, so that the bar 12 displaces a supporting shaft 8 in the stripping claw 5 leftward. Accordingly, the front end 7 of the stripping claw 5 retreats from a guide surface 6. Conversely, when the paper guide 4 is set, the operating plate 13 is slid in a direction indicated by an arrow X2, and the front end 7 of the stripping claw 5 is displaced to the position in contact with the surface of the pressure roller 2.

8 Claims, 3 Drawing Sheets

PAPER GUIDING SYSTEM

This application is based on an application No. 11-72141 filed in Japan, the content of which is incorporated hereinto by reference.

BACKGROUND OF THE INVENTION

1. Field of the Invention

The present invention relates to a paper guiding device, applied to an image forming apparatus for forming an image by an electrophotographic system, for guiding paper discharged from a fixing device for fixing a toner image transferred to the paper. More specifically, it is directed to a paper guiding device comprising a stripping claw so adapted that paper fed from a processing roller in a fixing device is not affixed to the processing roller, and relates to the construction and the like of the stripping claw.

2. Description of the Related Art

Examples of an image forming apparatus for forming an image by an electrophotographic system include a copying machine and a laser printer. The apparatus comprises a fixing device for fixing a toner image transferred to paper. The fixing device generally comprises a pair of rollers, that is, a heat roller and a pressure roller. The paper passes between the rollers, so that toner transferred to the paper is heated and is pressurized. Accordingly, the toner is melted, and the melted toner is fixed to the paper. Generally, the heat roller heats the toner in contact with the surface of the paper to which the toner has been transferred, and the pressure roller pressurizes the toner in contact with the reverse surface of the paper.

Many of the conventional image forming apparatuses are so constructed as to convey paper horizontally with respect to the fixing device. The toner has been transferred to the surface (the upper surface) of the paper horizontally conveyed. Consequently, the heat roller and the pressure roller are respectively arranged in upper and lower parts of the fixing device, and the paper horizontally passes between the rollers.

When the paper is jammed in the fixing device, a paper guide, for example, is made movable in order to release the jam.

In such conventional construction that the paper is horizontally conveyed, the pressure roller provided in the lower part of the fixing device, a stripping claw for preventing the paper from adhering to the pressure roller, and a lower guide for guiding the paper are generally fixed.

SUMMARY OF THE INVENTION

Some of recent image forming apparatuses are so constructed that paper is conveyed not horizontally but almost vertically upward from below with respect to a fixing device. In such construction that paper is conveyed perpendicularly with respect to the fixing device, a heat roller and a pressure roller are arranged in the horizontal direction. In this case, a paper guide provided on the side of the pressure roller must be made movable from the viewpoint of the facility of jam processing, unlike that in a case where the paper is horizontally conveyed.

In a case where the paper guide on the side of the pressure roller is made movable, when the paper guide is returned to a predetermined position after jam processing, a stripping claw projecting from the paper guide abuts against the surface of the pressure roller, so that the surface of the pressure roller may, in some cases, be damaged.

Such a problem should be solved even when not only the paper guide provided in the pressure roller but also a paper guiding device for guiding paper fed from the processing roller has a claw for stripping the paper from the processing roller.

The present invention has been made in order to solve such a problem, and has for its object to provide a paper guiding device so improved that the surface of a processing roller is prevented from being damaged upon abutment of a stripping claw for stripping paper from the processing roller against the surface of the processing roller when a paper guide is made movable in order to perform jam processing or the like.

The present invention is directed to a paper guiding device for guiding paper fed from a processing roller for processing the paper, which is characterized by comprising a paper guide, having a guide surface, for guiding the paper fed from the processing roller along the guide surface, a stripping claw provided in the paper guide, projecting from the guide surface, and having its front end brought into sliding contact with the surface of the processing roller, claw displacement means for displacing the stripping claw, such that the front end of the stripping claw separates from a position in contact with the surface of the processing roller, in synchronism with an operation for releasing the paper guide from the processing roller.

According to the above-mentioned construction, the stripping claw is displaced such that the front end of the stripping claw separates from the position in contact with the surface of the processing roller in synchronism with the operation of releasing the paper guide from the processing roller. In releasing the paper guide from the processing roller, therefore, the surface of the processing roller may not be damaged by the stripping claw.

The claw displacement means displaces the stripping claw to the position spaced apart from the surface of the processing roller until the paper guide is set in a predetermined position. When the paper guide is set, therefore, the stripping claw may not be pressed against the surface of the processing roller.

More specifically, the claw displacement means displaces, when the paper guide which is operated to be released is set, the stripping claw in the opposite direction to that in a case where the paper guide is operated to be released. After the paper guide is set, therefore, the stripping claw is also abutted against the surface of the processing roller. Accordingly, the surface of the processing roller may not be damaged by the front end of the stripping claw.

According to the present invention, the processing roller can be prevented from being damaged by the stripping claw, and the life of the processing roller can be lengthened. Further, the stripping claw can be displaced in synchronism with the operation of releasing the paper guiding device. In the paper guiding device, therefore, no problem arises in jam processing or the like, and the processing roller is not damaged by the stripping claw.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
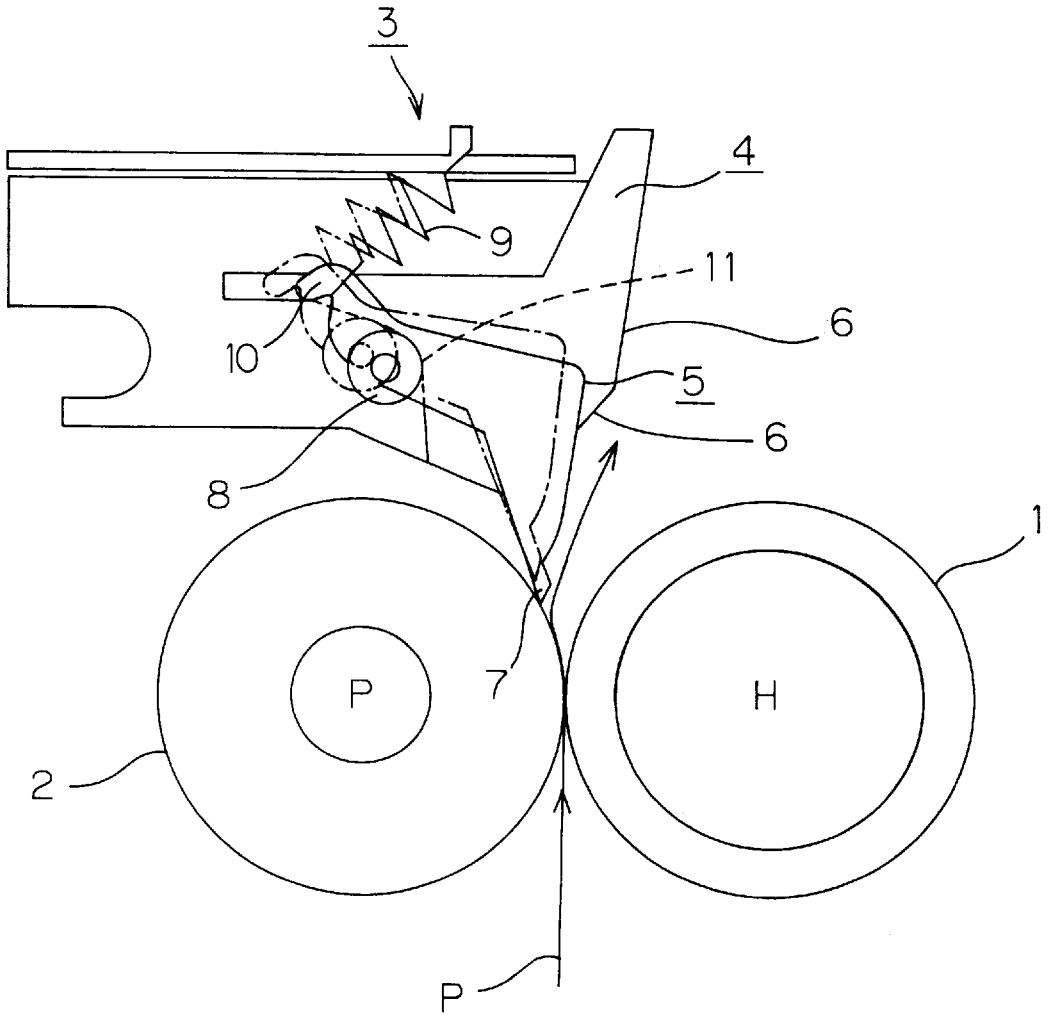
FIG. 1 is an illustrative cross-sectional view for explaining a stripping operation of a stripping claw in a paper guiding device according to one embodiment of the present invention.

Referring now to the drawings, one embodiment of the present invention will be described in detail.

FIG. 1 is an illustrative cross-sectional view showing the construction of one embodiment of the present invention that is applied to a fixing device in an image forming apparatus.

In FIG. 1, a heat roller 1 and a pressure roller 2 are arranged almost horizontally. Paper is conveyed almost perpendicularly upward from below, as indicated by an arrow P. When the paper P passes between the heat roller 1 and the pressure roller 2, toner which has been transferred to the paper is heated by the heat roller 1, and the paper is interposed between the heat roller 1 and the pressure roller 2 so that the toner is pressurized. Accordingly, the toner is melted, and the melted toner is fixed to the paper.

When the paper passes between the heat roller 1 and the pressure roller 2, the paper may not, in some cases, easily separate from the surface of the heat roller 1 and the surface of the pressure roller 2 upon being affixed thereto by the melting of the toner, the function of a static charge, and the others. Therefore, stripping claws for stripping the paper which has been affixed to the heat roller land the pressure roller 2 are respectively provided on the side of outlets of the heat roller 1 and the pressure roller 2.

The present embodiment is applied to not the construction of the stripping claw on the side of the heat roller 1 but the construction of the stripping claw on the side of the pressure roller 2. Accordingly, the stripping claw on the side of the heat roller 1 is omitted in FIG. 1. The construction of a paper guiding device 3 comprising the stripping claw on the side of the pressure roller 2, and a paper guide 4, and so forth will be described in detail.

The paper guiding device 3 according to the present embodiment is an apparatus for guiding paper fed from the pressure roller 2. The paper guiding device 3 comprises a paper guide 4 and a stripping claw 5. The paper guide 4 is provided with a guide surface 6 for guiding the paper in a predetermined direction. The stripping claw 5 is attached to the paper guide 4, and its front end 7 projects from a guide surface 6 and is in contact with the surface of the pressure roller 2.

The stripping claw 5 has a side surface whose shape (shown in FIG. 1) is an approximately L shape, and has a supporting shaft 8 provided in its middle part. There is provided a force applying point 10, with which a spring 9 is engaged, on the opposite side to the front end 7 with respect to the supporting shaft 8. The stripping claw 5 is elastically urged in a clockwise direction.

On the other hand, the paper guide 4 comprises a bearing 11 for holding the supporting shaft 8 in the stripping claw 5. The stripping claw 5 is held so as to be rotatable around the supporting shaft 8 while the supporting shaft 8 is being brought into sliding contact with the bearing 11 and so as to be slidable along the bearing 11.

When the front end 7 of the stripping claw 5 is pressed upward by the paper to be conveyed, therefore, the stripping claw 5 is displaced upward from a state indicated by a solid line to a state indicted by a one-dot and dash line in FIG. 1. Accordingly, the front end 7 of the stripping claw 5 does not cut into the pressure roller 2, and so functions as to strip the paper affixed to the pressure roller 2, to guide the paper along the guide surface 6.

The stripping claw 5 is rotated around the supporting shaft 8. Also, the position of the supporting shaft 8 is slidable. As a result, the front end 7 of the stripping claw 5 is not rotated in such a direction as to cut into the surface of the pressure roller 2. Moreover, the performance of stripping the paper affixed to the surface of the pressure roller 2 is ensured.

The construction of the stripping claw 5 is basically the same as the construction of a stripping claw which is disclosed in JP-A-10-209990 according to the prior application by the applicant of the present invention.

Figure 2:
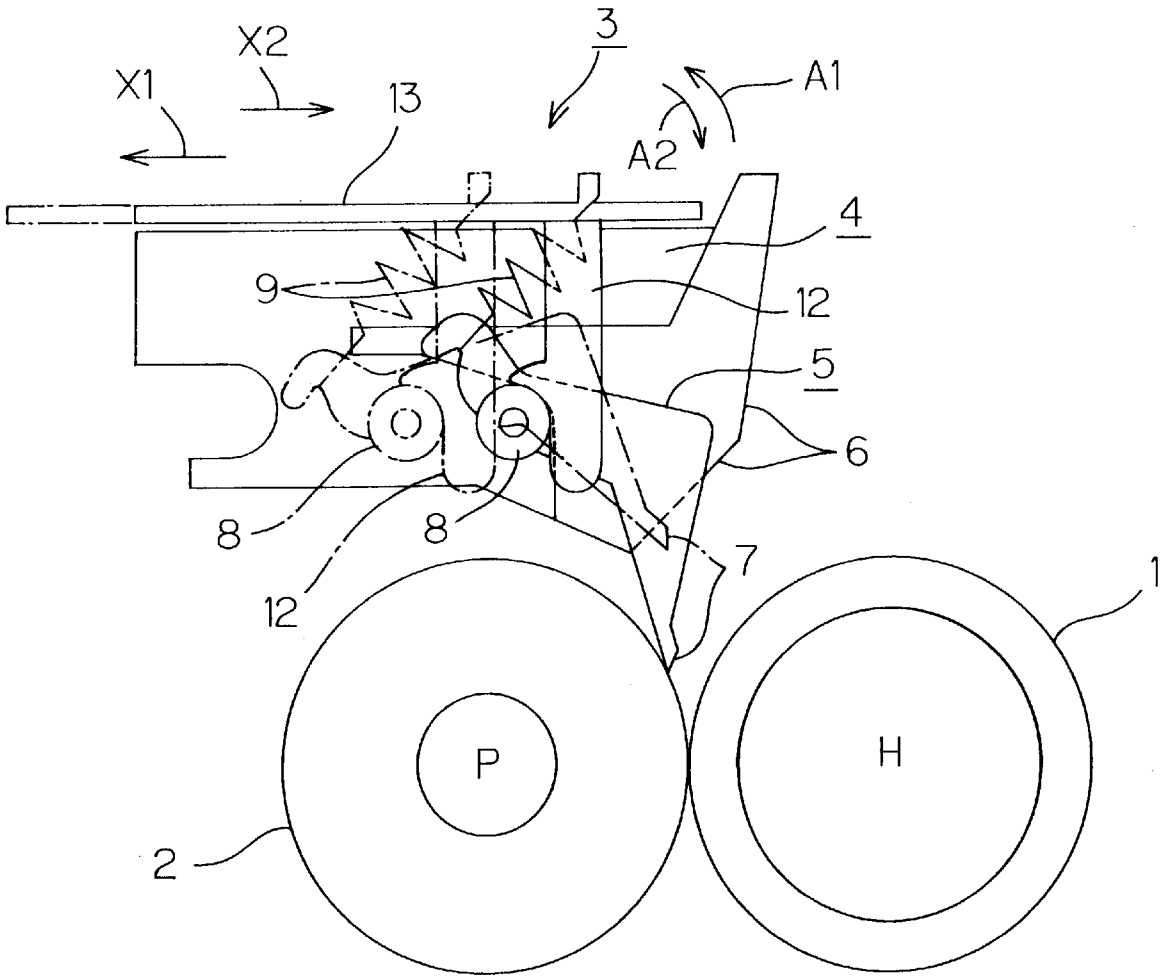
FIG. 2 is an illustrative cross-sectional view for explaining operations that characterize the paper guiding device according to one embodiment of the present invention.
Figure 3:
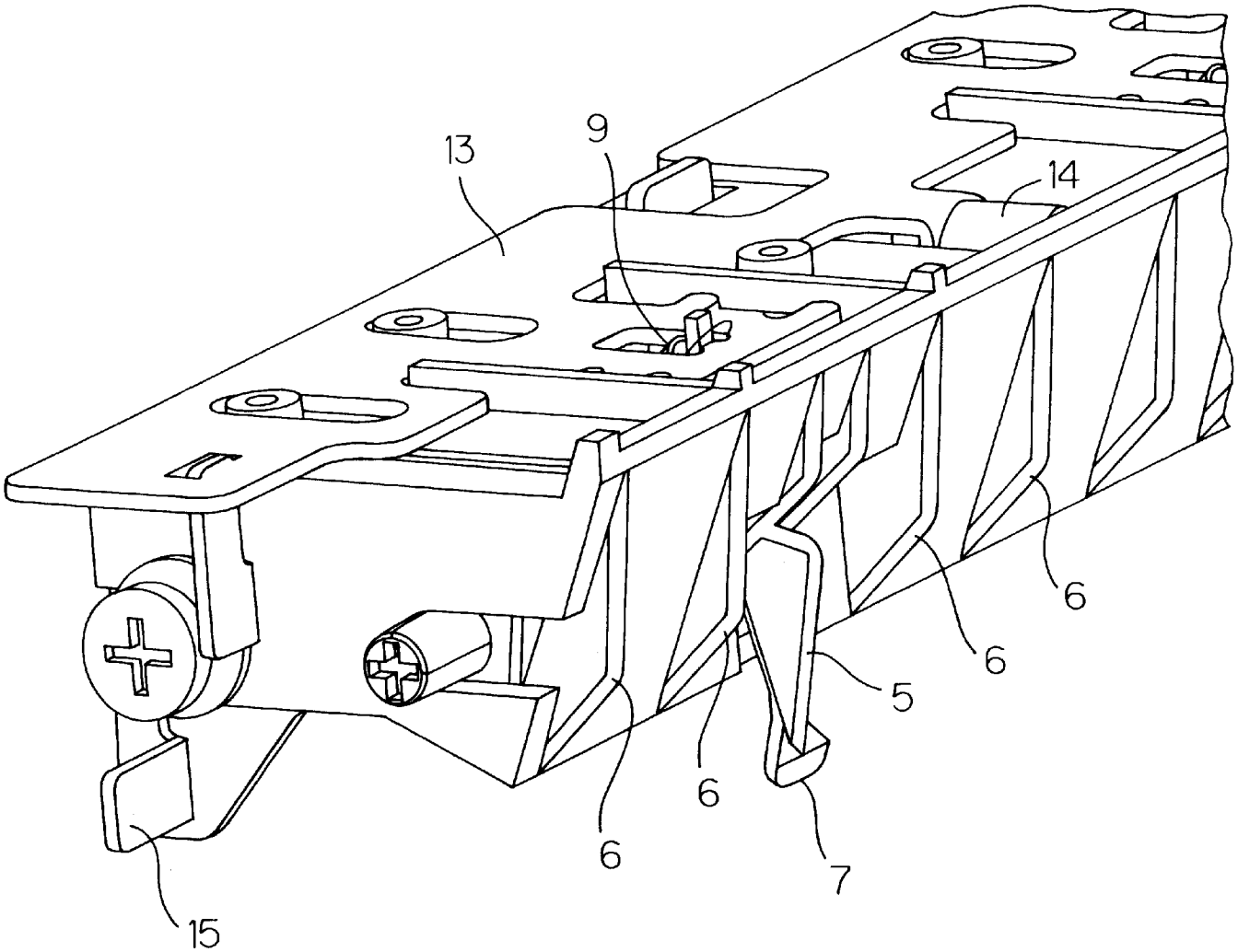
FIG. 3 is a partially perspective view of the paper guiding device according to one embodiment of the present invention.

FIG. 2 is an illustrative cross-sectional view for explaining construction that characterizes the paper guiding device 3 according to the present embodiment. FIG. 3 is a partially perspective view showing the construction of the paper guiding device 3.

Referring to FIGS. 2 and 3, the paper guiding device 3 is provided with a claw displacement mechanism for displacing the stripping claw 5 in addition to the construction shown in FIG. 1. The claw displacement mechanism has bars 12 and an operating plate 13 to which the bars 12 are attached. The operating plate 13 is provided so as to be horizontally slidable along the upper surface of the paper guide 4. The bar 12 projects almost perpendicularly downward from the operating plate 13. The bar 12 is so arranged that its lower part can be engaged with the supporting shaft 8 in the stripping claw 5.

When the operating plate 13 is slid in a direction indicated by an arrow X1 in FIG. 2, the bar 12 presses the supporting shaft 8 leftward, to displace the supporting shaft 8 while rotating the whole of the stripping claw 5 in a direction indicated by an arrow A1.

More specifically, the stripping claw 5 whose front end 7 projects from the guide surface 6 (see FIGS. 2 and 3) is displaced leftward around the supporting shaft 8 and is rotated in the direction indicated by the arrow A1. Accordingly, the stripping claw 5 can be displaced to a state where the front end 7 does not project from the guide surface 6 while being rotated in a counterclockwise direction (see a one-dot and dash line in FIG. 2).

Conversely, it is assumed that the operating plate 13 is slid in a direction indicated by an arrow X2 from the state, indicated by the one-dot and dash line in FIG. 2, of the stripping claw 5. Consequently, the bar 12 is also displaced rightward. At this time, the stripping claw 5 is elastically urged on the side of the force applying point 10 by the spring 9. Accordingly, as the bar 12 is moved rightward, the stripping claw 5 is also moved rightward and is rotated in a clockwise direction (in a direction indicated by an arrow A2).

Therefore, the front end 7 of the stripping claw 5 is displaced, while being rotated in the direction indicated by the arrow A2, from the state indicated by the one-dot and dash line to a state indicated by a solid line in FIG. 2.

Therefore, the front end 7 of the stripping claw 5 gently abuts against the surface of the pressure roller 2, not to damage the surface of the pressure roller 2.

In the above-mentioned description, the movement of the paper guide 4 is not referred to for easy understanding of the function of the claw displacement mechanism having the bar 12 and the operating plate 13 and the operation of the stripping claw 5 displaced by the claw displacement mechanism.

At the time of jam processing, however, the whole of the paper guide 4 is actually displaced so as to be released from the pressure roller 2. Specifically, the paper guide 4 is rotated and displaced in the direction indicated by the arrow A1 in FIG. 2, and is released from the pressure roller 2. If the jam processing is terminated, the paper guide 4 is rotated in the direction indicated by the arrow A2, and is set in the state indicated by the solid line in FIG. 2.

The operations of the bar 12 and the operating plate 13 are synchronized with an operation of releasing the paper guide 4. That is, the operating plate 13 is slid in the direction indicated by the arrow X1 in FIG. 2 in synchronism with the rotation of the paper guide 4 in the direction indicated by the arrow A1. Conversely, when the paper guide 4 is set in the direction indicated by the arrow A2, the operating plate 13 is slid in the direction indicated by the arrow X2.

The synchronized sliding operation of the operating plate 13 is realized by a coil spring denoted by 14 in FIG. 3.

The coil spring 14 always elastically urges the sliding plate 13 in the direction indicated by the arrow X1. When the paper guide 4 is in its set position, an operating arm 15 connected to the operating plate 13 abuts against a frame of a fixing device (not shown), not to rotate rightward. Accordingly, the operating plate 13 is prevented from being slid in the direction indicated by the arrow X1 by the coil spring 14.

On the other hand, when the paper guide 4 is rotated in the direction indicated by the arrow Al, the control by the operating arm 15 is released, so that the operating plate 13 is slid in the direction indicated by the arrow X1 by an elastic force of the coil spring 14.

Although in FIG. 3, only a part, on this side, of the paper guiding plate 3 is illustrated, the paper guiding device 3 is in a longitudinal shape along an axis of rotation of the pressure roller 2, and a plurality of (for example, four) stripping claws 5 are arranged. All the four stripping claws 5 are displaced in synchronism with an operation of releasing the paper guide 4, as described above, by the corresponding bars 12 provided on the operating plate 13 (see FIG. 2).

Although description was made taking the paper guiding device 3 for the pressure roller 2 in the fixing device as an example, the same construction can be also applied to the paper guiding device on the side of the heat roller 1.

The paper guiding device according to the present invention is also applicable to another processing roller in the image forming apparatus.

Various design changes can be made in the range of technical terms described in the claims.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A paper guiding device for guiding paper fed from a processing roller for processing the paper, comprising:

a paper guide, having a guide surface for guiding the paper fed from the processing roller along the guide surface, and having a bearing opening therein;

a stripping claw movably attached to the paper guide and having a front end positionable to project beyond the guide surface into sliding contact with a surface of the processing roller;

a supporting shaft for slidably supporting the stripping claw, the support shaft being slidably movable in the bearing opening of the paper guide; and claw displacement means for displacing the stripping claw such that the front end of the stripping claw separates from a position in contact with the surface of the processing roller in synchronism with releasing of the paper guide from the processing roller.

2. The paper guiding device according to claim 1, wherein the supporting shaft is located at a position spaced apart from the claw front end, a force applying point is located opposite to the claw front end with respect to the location of the supporting shaft, and the stripping claw is rotatable about the supporting shaft and the supporting shaft is slidable to move to a predetermined position in the bearing opening, and wherein the paper guide device further comprises an elastic member for urging the stripping claw to abut the front end thereof against the surface of the processing roller, the elastic member being arranged between the paper guide and the force applying point on the stripping claw.

3. The paper guide device according to claim 2, wherein the claw displacement means comprises a bar, engagable with the supporting shaft for rotating the stripping claw while sliding the stripping claw in a predetermined direction in synchronism with releasing the paper guide.

4. the paper guide device according to claim 3, wherein the bar is attached to an operating plate, and the operating plate is slidable with respect to the paper guide, and is elastically urged, such that the operating plate is slid in a predetermined direction in response to releasing of the paper guide.

5. The paper guide device according to claim 1, wherein the processing roller is a pressure roller, provided in an image forming apparatus, for fixing toner.

6. The paper guide device of claim 1, wherein the stripping claw has approximately an L shape, and the stripping claw attaches to the support shaft at a curved portion in a central portion thereof.

7. The paper guide device of claim 1, wherein the claw displacement mechanism further comprises:

an operating plate, slidable in a displacing direction;

a bar which projects from the operating plate and which presses the supporting shaft to slide along the bearing opening for releasing the stripping claw as the operating plate slides in the displacing direction.

8. The paper guide device of claim 1, further comprising a heat roller and a pressure roller arranged generally horizontally, and wherein paper is conveyed from the heat roller and the pressure roller toward the paper guide almost perpendicularly upward from below the paper guide.

* * * * *